US010930410B1

(12) United States Patent
Mundt et al.

(10) Patent No.: US 10,930,410 B1
(45) Date of Patent: Feb. 23, 2021

(54) FLAT FLEXIBLE CABLE WITH BONDED GROUND WIRES AND METHOD FOR FORMING SAME

(71) Applicant: Dell Products L.P., Round Rock, TX (US)

(72) Inventors: Kevin W. Mundt, Austin, TX (US); Bhyrav M. Mutnury, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/681,000

(22) Filed: Nov. 12, 2019

(51) Int. Cl.
*H01B 7/08* (2006.01)
*H01R 12/77* (2011.01)

(52) U.S. Cl.
CPC ..... *H01B 7/0838* (2013.01); *H01R 12/775* (2013.01)

(58) Field of Classification Search
CPC ..... H01B 7/0838; H01R 12/775
See application file for complete search history.

(56) References Cited

U.S. PATENT DOCUMENTS 3,876,964 A * 4/1975 Balaster ..... H01B 7/0838 333/238
4,418,239 A * 11/1983 Larson ..... H01B 7/08 174/117 FF
8,907,226 B2 * 12/2014 Tsuji ..... H05K 3/24 174/256

* cited by examiner

*Primary Examiner* — Ross N Gushi
(74) *Attorney, Agent, or Firm* — Jackson Walker L.L.P.

(57) ABSTRACT

A flat flexible cable may include a plurality of generally parallel, co-planar flat conductive traces sandwiched between two ribbons of dielectric material and a plurality of strips of conductive material formed at intervals along a length of the flat flexible cable, each strip of conductive material electrically coupling a plurality of ground traces of the flat conductive traces to one another via portions of the ground traces exposed through the dielectric material at each of the intervals.

7 Claims, 6 Drawing Sheets

FLAT FLEXIBLE CABLE WITH BONDED GROUND WIRES AND METHOD FOR FORMING SAME

TECHNICAL FIELD

The present disclosure relates in general to information handling systems, and more particularly to a flat flexible cable with bonded ground wires and a method for forming same.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

In many applications, one or multiple information handling servers may be installed within a single chassis, housing, enclosure, or rack. Communication between servers and/or between enclosures or even within the same enclosure or same rack may often be accomplished via cables.

As communication bus speeds increase in information handling systems, trace lengths on motherboards are reaching their limits due to losses in signal integrity. An approach that is often employed for a longer conductive path in an information handling system is the use of cables. However, high speed cables are often costly. High speed cables are traditionally fabricated from single strands of twin micro-coaxial wire and often require a tedious and expensive assembly process to couple the wires to a high-speed connector terminating the cable.

However, flat flexible cables are emerging as fairly inexpensive solutions to cabling needs in information handling systems. Flat flexible cables are typically formed by calendaring conductive traces (e.g., copper) into flat traces, sandwiching these flat conductive traces, at a specific pitch, between two ribbons of dielectric material (e.g., plastic), exposing the ends of a cable to create electrical contacts, and then overmolding a connector onto each end for coupling the cable to an information handling resource. Flat flexible cables, sometimes referred to as ribbon cables, have long been used in notebook computers but have typically suffered from signal speed limitations that have prevented their use in some high-speed applications. One problem with flat flexible cables is such cables can suffer from high amounts of cross-talk or electrical coupling between the traces, leading to poor signal integrity. Such cross-talk may be caused by signal ringing from one end of the cable to the other end of the cable.

SUMMARY

In accordance with the teachings of the present disclosure, the disadvantages and problems associated with undesirable signal integrity in flat flexible cables may be reduced or eliminated.

In accordance with embodiments of the present disclosure, a flat flexible cable may include a plurality of generally parallel, co-planar flat conductive traces sandwiched between two ribbons of dielectric material and a plurality of strips of conductive material formed at intervals along a length of the flat flexible cable, each strip of conductive material electrically coupling a plurality of ground traces of the flat conductive traces to one another via portions of the ground traces exposed through the dielectric material at each of the intervals.

In accordance with these and other embodiments of the present disclosure, an information handling system may include two information handling resources and a flat flexible cable assembly electrically coupled to each of the two information handling resources and configured to electrically couple the two information handling resources together. The flat flexible cable assembly may include a plurality of generally parallel, co-planar flat conductive traces sandwiched between two ribbons of dielectric material and a plurality of strips of conductive material formed at intervals along a length of the flat flexible cable assembly, each strip of conductive material electrically coupling a plurality of ground traces of the flat conductive traces to one another via portions of the ground traces exposed through the dielectric material at each of the intervals.

In accordance with these and other embodiments of the present disclosure, a method for forming a flat flexible cable from a raw flat flexible cable comprising a plurality of generally parallel, co-planar flat conductive traces sandwiched between two ribbons of dielectric material may be provided. The method may include selectively removing the dielectric material at intervals along a length of the raw flat flexible cable to expose a plurality of ground traces of the flat conductive traces at each of the intervals and forming at each interval a strip of conductive material, each strip of conductive material electrically coupling a plurality of ground traces of the flat conductive traces to one another at such interval.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1 through 6, wherein like numbers are used to indicate like and corresponding parts.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

For the purposes of this disclosure, information handling resources may broadly refer to any component system, device or apparatus of an information handling system, including without limitation processors, service processors, basic input/output systems, buses, memories, I/O devices and/or interfaces, storage resources, network interfaces, motherboards, air movers, sensors, power supplies, and/or any other components and/or elements of an information handling system.

Figure 1:
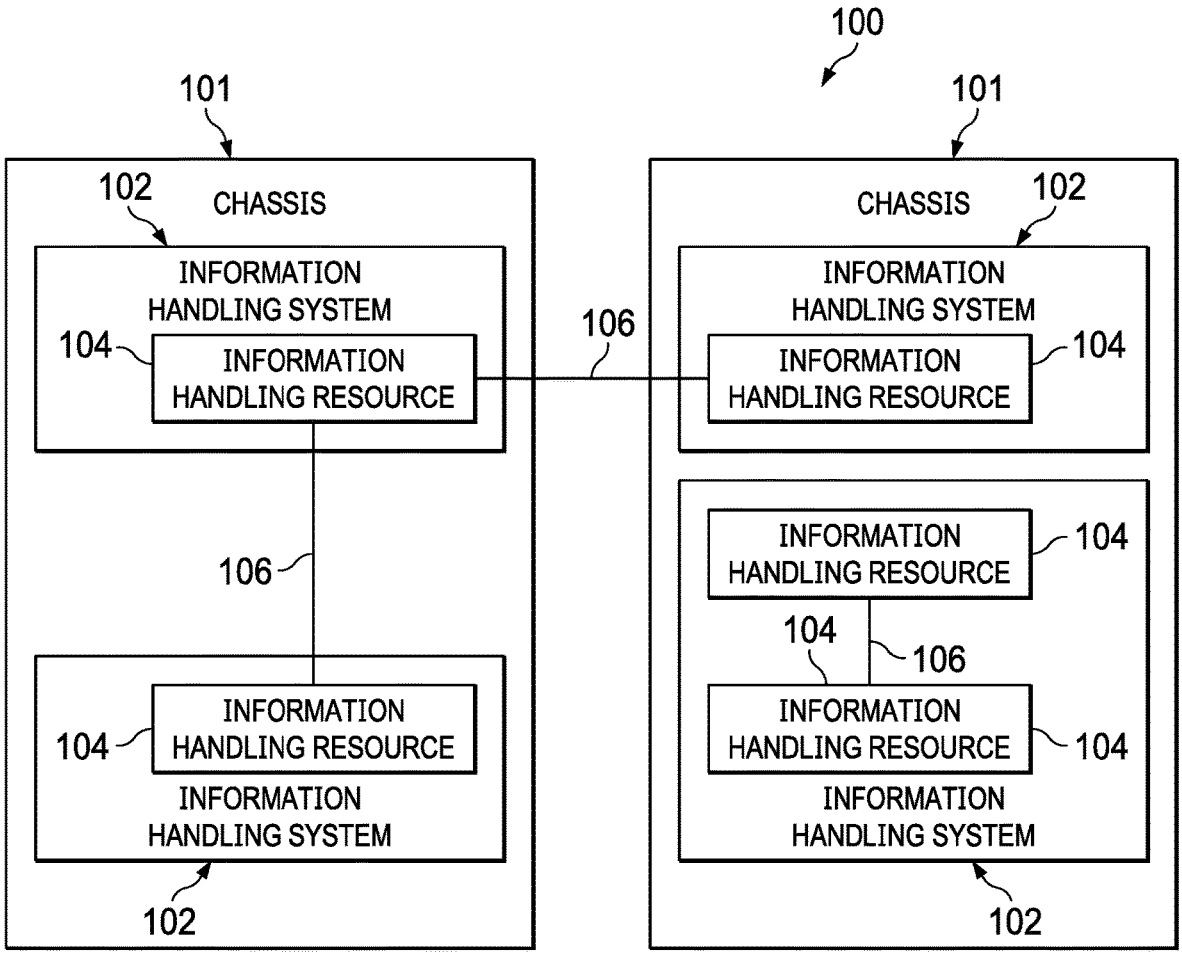
FIG. 1 illustrates a system comprising a plurality of chassis, each chassis comprising at least one information handling system, in accordance with embodiments of the present disclosure.

FIG. 1 illustrates a system 100 comprising a plurality of chassis 101, each chassis 101 comprising at least one information handling system 102, in accordance with embodiments of the present disclosure. Each chassis 101 may be an enclosure that serves as a container for various information handling systems 102 and information handling resources 104, and may be constructed from steel, aluminum, plastic, and/or any other suitable material. Although the term "chassis" is used, a chassis 101 may also be referred to as a case, cabinet, tower, box, enclosure, and/or housing. In certain embodiments, a chassis 101 may be configured to hold and/or provide power to one or more information handling systems 102 and/or information handling resources 104.

In some embodiments, one or more of information handling systems 102 may comprise servers. For example, in some embodiments, information handling systems 102 may comprise rack servers and each chassis 101 may comprise a rack configured to house such rack servers. As shown in FIG. 1, each information handling system 102 may include one or more information handling resources 104. An information handling resource 104 may include any component system, device, or apparatus of an information handling system 102, including without limitation processors, service processors, basic input/output systems, buses, memories, I/O devices and/or interfaces, storage resources, network interfaces, motherboards, air movers, sensors, power supplies, and/or any other components and/or elements of an information handling system. For example, in some embodiments, an information handling resource 104 of an information handling system 102 may comprise a processor. Such processor may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, a processor may interpret and/or execute program instructions and/or process data stored in a memory and/or another information handling resource of an information handling system 102.

In these and other embodiments, an information handling resource 104 of an information handling system 102 may comprise a memory. Such a memory may be communicatively coupled to an associated processor and may include any system, device, or apparatus configured to retain program instructions and/or data for a period of time (e.g., computer-readable media). A memory may include RAM, EEPROM, a PCMCIA card, flash memory, magnetic storage, opto-magnetic storage, or any suitable selection and/or array of volatile or non-volatile memory that retains data after power to an associated information handling system 102 is turned off.

In addition to a processor and/or a memory, an information handling system 102 may include one or more other information handling resources.

As shown in FIG. 1, information handling resources 104 may be communicatively coupled to each other via a cable assembly 106, whether such information handling resources 104 are within different information handling systems 102 in the same chassis 101, are within different information handling systems 102 in different chassis 101, or are within the same information handling system 102. A cable assembly 106 may include any suitable assembly of two or more electrically-conductive wires running side by side to carry one or more signals between information handling resources. In some embodiments, such a cable assembly 106 may include flat flexible cable assembly created using method 200 below and as shown in greater detail in FIGS. 3-6 below.

Figure 2:
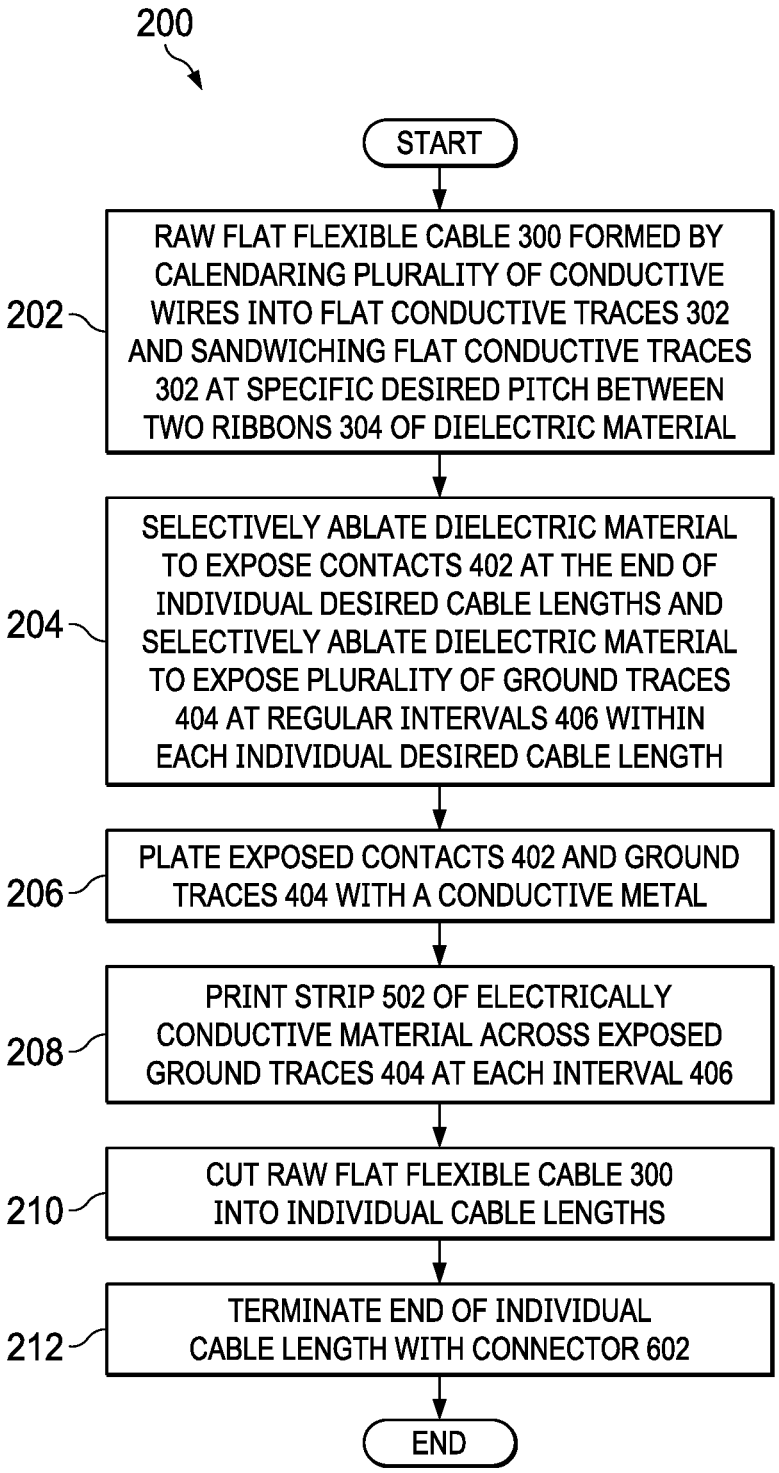
FIG. 2 illustrates a flow chart of an example method for forming a plurality of flat flexible cables with bonded ground wires, in accordance with embodiments of the present disclosure.

FIG. 2 illustrates a flow chart of an example method 200 for forming a plurality of flat flexible cable assemblies 106 with bonded ground wires, in accordance with embodiments of the present disclosure. According to some embodiments, method 200 may begin at step 202. However, the preferred initialization point for method 200 and the order of the steps comprising method 200 may depend on a chosen implementation.

Figure 3:
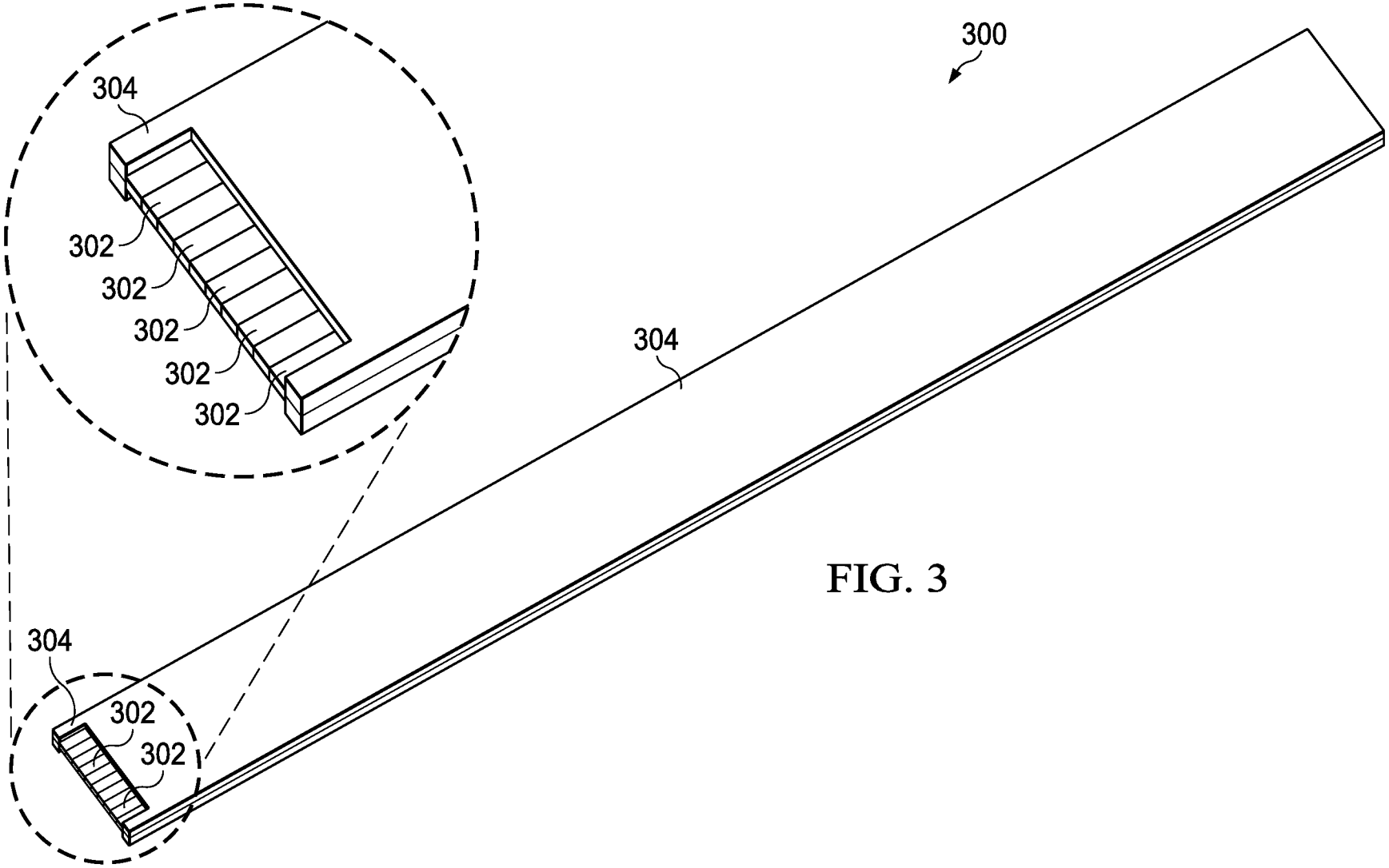
FIG. 3 illustrates an isometric view of a raw flat flexible cable, in accordance with embodiments of the present disclosure.

At step 202, and as shown in FIG. 3, a raw flat flexible cable 300 may be formed by calendaring (e.g., rolling) a plurality of conductive wires (e.g., copper wires) into flat conductive traces 302 and sandwiching the plurality of flat conductive traces 302, at a specific desired pitch from one another, between two ribbons 304 of dielectric material (e.g., plastic) such that flat conductive traces 302 are generally parallel and co-planar with one another, and with the dielectric material electrically insulating adjacent flat conductive traces 302 from one another. The result may be a long, raw flat flexible cable 300 which may be spooled onto a reel, and later separated into multiple flexible cable assemblies as described below. It is noted that for the purposes of clarity and exposition, flat conductive traces 302 are shown as exposed in FIG. 3. However, flat conductive traces 302 may remain completely surrounded by ribbons 304 of dielectric material.

Figure 4:
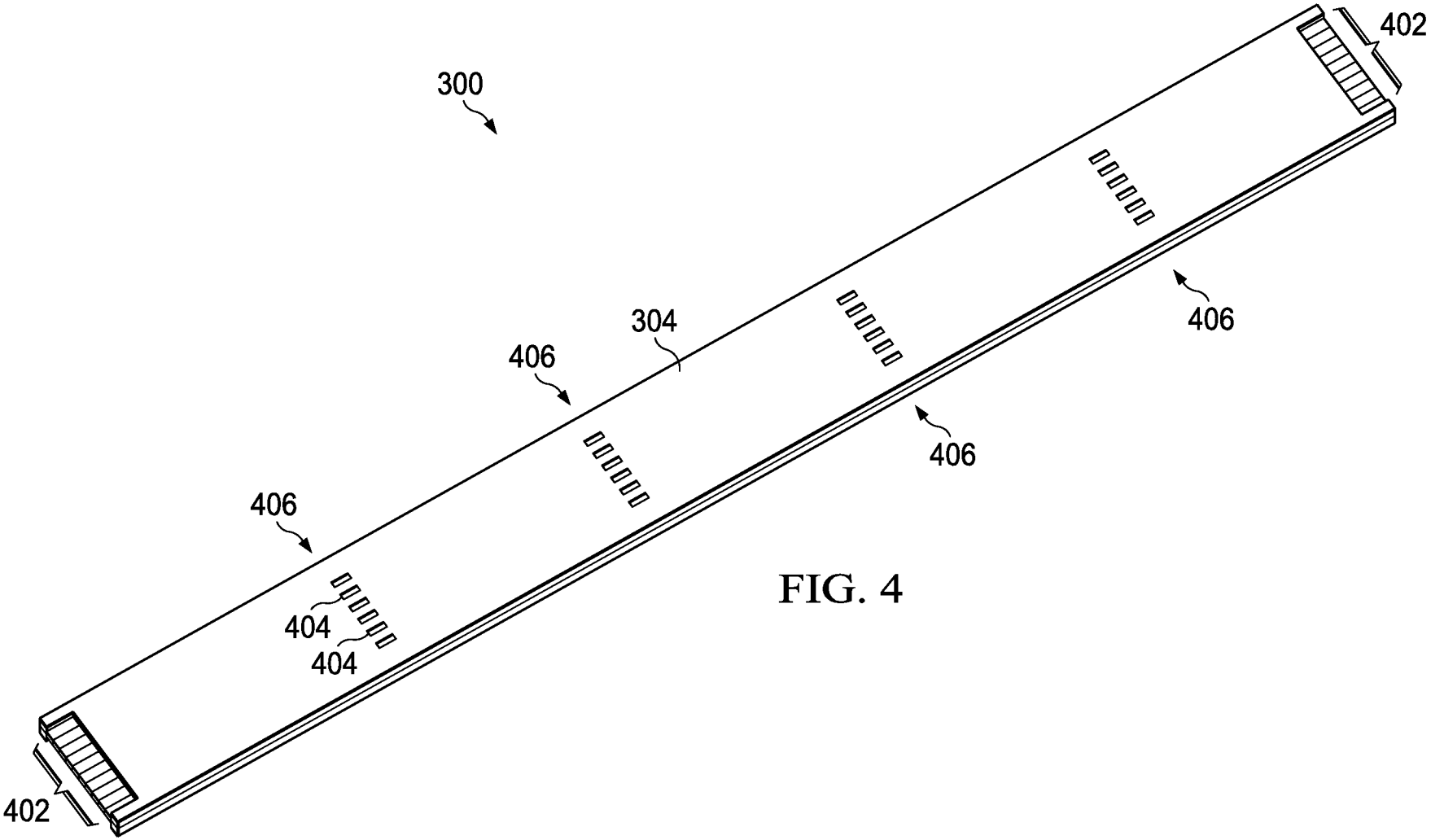
FIG. 4 illustrates an isometric view of a flat flexible cable with exposed contacts at ends of desired cable lengths of the flat flexible cable and exposed ground traces at regular intervals of the flat flexible cable, in accordance with embodiments of the present disclosure.

At step 204, during a transfer of raw flat flexible cable 300 from one reel to another reel, throughout the length of raw flat flexible cable 300, a laser or other suitable device may selectively ablate dielectric material to expose contacts at the end of individual desired cable lengths and selectively ablate dielectric material to expose a plurality of ground traces at regular intervals within each individual desired cable length. FIG. 4 illustrates an isometric view of a raw flat flexible cable 300, showing a portion of the raw flat flexible cable 300, with exposed contacts 402 at ends of the desired length of raw flat flexible cable 300 and exposed ground traces 404 at regular intervals 406 of flat flexible cable 300 which may result from completion of step 204, in accordance with embodiments of the present disclosure. Ground traces 404 may comprise those flat conductive traces 302 of a raw flat flexible cable 300 which are configured such that when raw flat flexible cable 300 is sectioned into desired cable lengths, over-molded with a connector, and coupled to an information handling resource 104, ground traces 404 may be driven to a ground voltage by such information handling resource 104. As shown in FIG. 4, each ground trace 404 may be exposed at the same interval 406 along flat flexible cable 300. In some embodiments, contacts 402 and ground traces 404 may be exposed in a common processing step (e.g., during the same reel-to-reel transfer of raw flat flexible cable 300) while in other embodiments, contacts 402 and ground traces 404 may be exposed in different processing steps (e.g., during different reel-to-reel transfers of raw flat flexible cable 300).

At step 206, during a transfer of raw flat flexible cable 300 from one reel to another reel, a plating apparatus may, throughout the length of raw flat flexible cable 300, plate exposed contacts 402 and ground traces 404 with a conductive metal (e.g., gold) to increase electrical conductivities of flat conductive traces 302. In some embodiments, contacts 402 and ground traces 404 may be plated in a common processing step (e.g., during the same reel-to-reel transfer of raw flat flexible cable 300) while in other embodiments, contacts 402 and ground traces 404 may be plated in different processing steps (e.g., during different reel-to-reel transfers of raw flat flexible cable 300).

Figure 5:
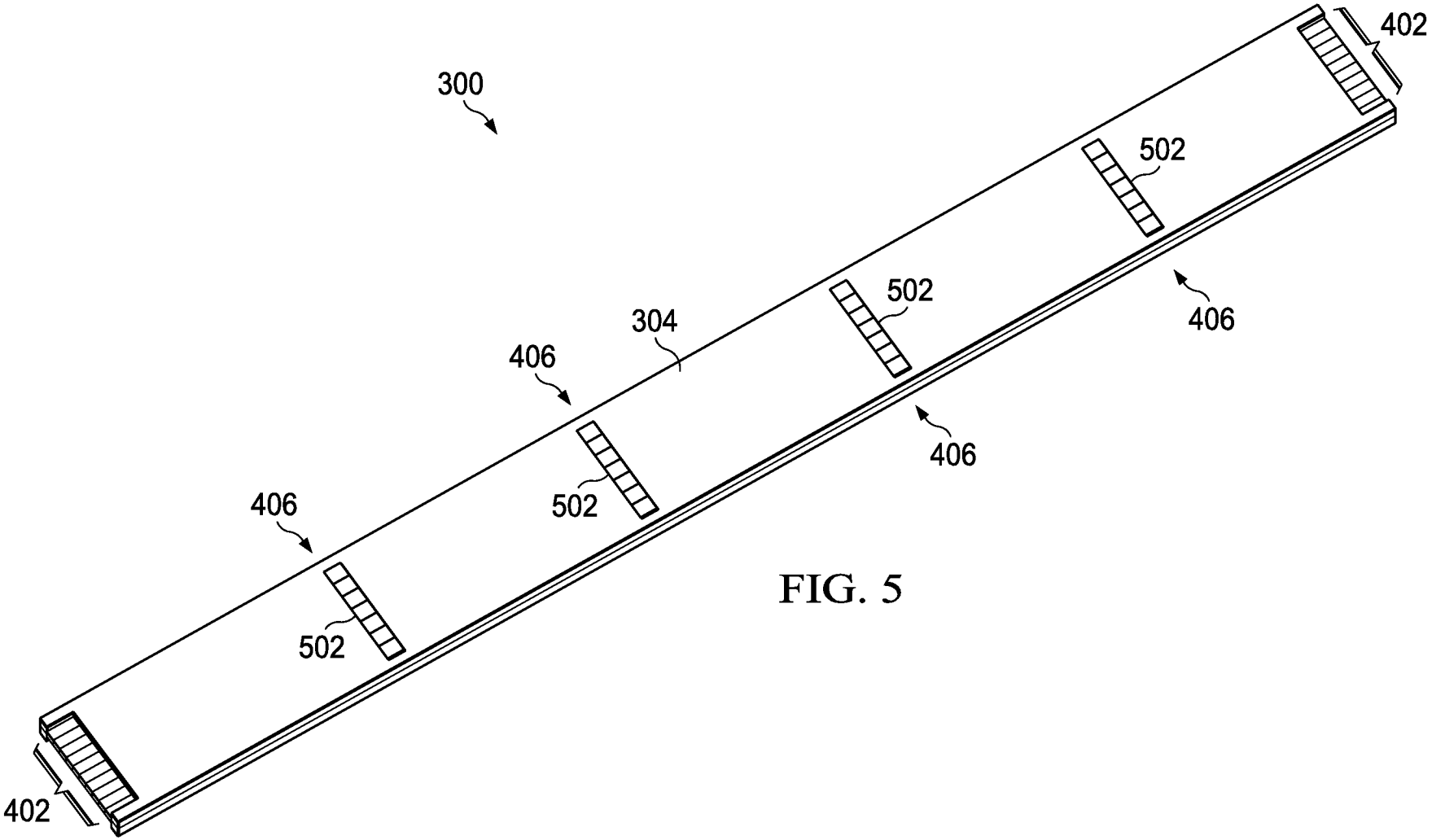
FIG. 5 illustrates an isometric view of a flat flexible cable with plated contacts at ends of the flat flexible cable and its exposed ground traces bonded together at regular intervals, in accordance with embodiments of the present disclosure.

At step 208, during a transfer of raw flat flexible cable 300 from one reel to another reel, a printer may, as shown in FIG. 5, throughout the length of raw flat flexible cable 300 and at each regular interval 406 at which ground traces 404 are exposed, print a strip 502 of electrically conductive material across the exposed ground traces 404 at such interval 406, electrically coupling the exposed ground traces 404 to one another at such interval 406. In some embodiments, such strip 502 may comprise an electrically-conductive carbon ink. In other embodiments, such strip 502 may comprise an electrically-conductive silver ink.

Figure 6:
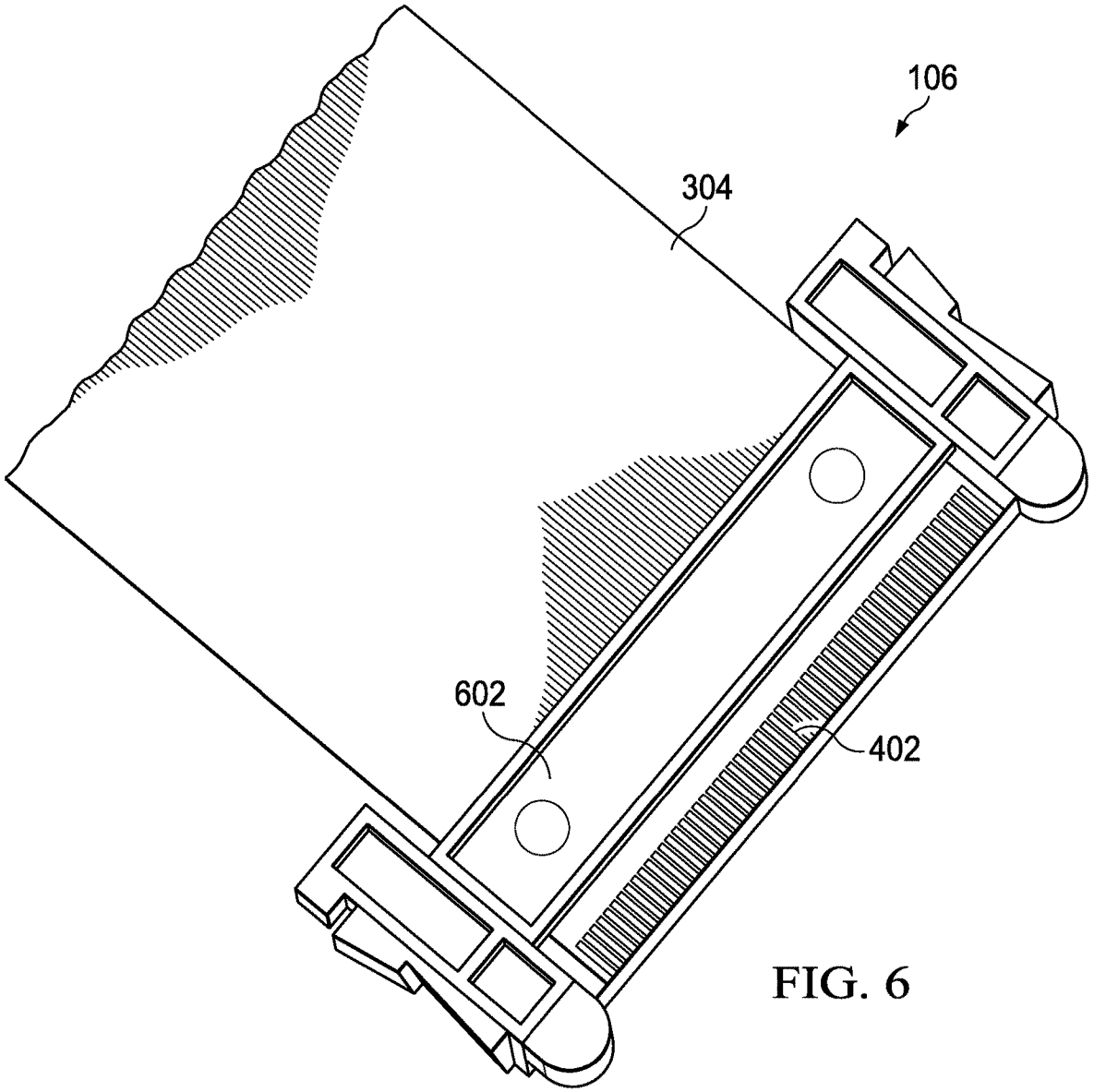
FIG. 6 illustrates an isometric view of an end of a flat flexible cable terminated with an over-molded connector to form a flat flexible cable assembly, in accordance with embodiments of the present disclosure.

At step 210, a suitable separator may cut raw flat flexible cable 300 into individual cable lengths such that each individual cable length has exposed contacts 402 at each of its ends. At step 212, and as shown in FIG. 6, a suitable device may over-mold or otherwise mechanically couple a connector 602 to an end of an individual cable length in order to form a flat flexible cable assembly 106. Connector 602 may comprise any suitable mechanical structure configured to mechanically engage with a corresponding connector (e.g., a receptacle connector) of an information handling resource 104 in order to maintain electrical connectivity between exposed contacts 402 of a flat flexible cable assembly 106 and respective contacts of the connector of the information handling resource 104. After completion of step 212, method 200 may end.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. A method for forming a flat flexible cable from a raw flat flexible cable comprising a plurality of generally parallel, co-planar flat conductive traces sandwiched between two ribbons of dielectric material, the method comprising:

selectively removing the dielectric material at intervals along a length of the raw flat flexible cable to expose a plurality of ground traces of the flat conductive traces at each of the intervals; and forming at each interval a strip of conductive material, each strip of conductive material electrically coupling a plurality of ground traces of the flat conductive traces to one another at such interval.

2. The method of claim 1, further comprising removing the dielectric material at at least one end of the flat flexible cable to form electrical contacts of the flat flexible cable.

3. The method of claim 2, further comprising removing the dielectric material to expose the portions of the ground traces and removing the dielectric material to expose the electrical contacts during a common manufacturing step of the flat flexible cable.

4. The method of claim 2, further comprising plating the electrical contacts and the portions of the ground traces exposed through the dielectric material.

5. The method of claim 4, further comprising plating the portions of the ground traces exposed through the dielectric material and plating the electrical contacts during a common manufacturing step of the flat flexible cable.

6. The method of claim 1, further comprising plating the portions of the ground traces exposed through the dielectric material.

7. The method of claim 1, wherein forming each strip of conductive material comprises printing the strip using an electrically-conductive printed ink.

* * * * *